US011964678B2

(12) United States Patent
Schoenly et al.

(10) Patent No.: US 11,964,678 B2
(45) **Date of Patent: *Apr. 23, 2024**

(54) COMMUNICATION SYSTEM AND METHOD OF A VEHICLE CONSIST

(71) Applicant: Transportation IP Holdings, LLC, Norwalk, CT (US)

(72) Inventors: Scott Alan Schoenly, Melbourne, FL (US); William Cherrick Schoonmaker, Melbourne, FL (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 380 days.

This patent is subject to a terminal disclaimer.

(21) Appl. No.: 17/492,749

(22) Filed: Oct. 4, 2021

(65) Prior Publication Data

US 2022/0024497 A1 Jan. 27, 2022

Related U.S. Application Data

(63) Continuation-in-part of application No. 16/193,783, filed on Nov. 16, 2018, now Pat. No. 11,142,221, which is a continuation of application No. 15/226,953, filed on Aug. 3, 2016, now Pat. No. 10,173,698, which is a continuation-in-part of (Continued)

(51) Int. Cl.

| | |
|---|---|
| ***B61C 17/12*** | (2006.01) |
| ***B61L 15/00*** | (2006.01) |
| ***B61L 25/02*** | (2006.01) |

(52) U.S. Cl.

CPC ..... *B61C 17/12* (2013.01); *B61L 15/0018* (2013.01); *B61L 15/0058* (2024.01); *B61L 15/0072* (2013.01); *B61L 25/023* (2013.01); *B61L 25/028* (2013.01); *B61L 2205/04* (2013.01)

(58) Field of Classification Search

CPC ..... B61C 17/12; B61L 3/006; B61L 15/0018; B61L 15/0072; B61L 15/0027; B61L 25/023; B61L 25/028; B61L 2205/04; G08G 1/22; H04W 4/46

See application file for complete search history.

(56) References Cited

U.S. PATENT DOCUMENTS 11,142,221 B2 * 10/2021 Schoenly ..... B61L 15/0072
2005/0093717 A1 * 5/2005 Lilja ..... G08G 1/0965 340/902

(Continued)

*Primary Examiner* — Michael J Zanelli

(74) *Attorney, Agent, or Firm* — The Small Patent Law Group LLC; Christopher R. Carroll

(57) ABSTRACT

A communication system and method receive, at an energy management system disposed onboard a vehicle system formed from a lead vehicle and one or more remote vehicles, trip data that represents one or more characteristics of an upcoming trip of the vehicle system along a route. A selected portion of the trip data is communicated from the energy management system to a distributed power system disposed onboard the vehicle system. The selected portion includes identifying information and one or more orientations of the one or more remote vehicles. Using the distributed power system, communication links between the lead vehicle and the one or more remote vehicles are established using the identifying information and the one or more orientations.

17 Claims, 6 Drawing Sheets

Related U.S. Application Data application No. 15/159,893, filed on May 20, 2016, now Pat. No. 9,963,154, and a continuation-in-part of application No. 14/881,445, filed on Oct. 13, 2015, now Pat. No. 9,862,392, which is a continuation-in-part of application No. 14/616,795, filed on Feb. 9, 2015, now abandoned.

(56) References Cited

U.S. PATENT DOCUMENTS

| | | | | |
|---|---|---|---|---|
| 2012/0253646 | A1* | 10/2012 | Reghunath | G08G 1/0145 701/117 |
| 2017/0053530 | A1* | 2/2017 | Gogic | H04L 67/12 |
| 2017/0090473 | A1* | 3/2017 | Cooper | H04W 76/11 |
| 2018/0004228 | A1* | 1/2018 | Zarella | B61L 15/0072 |
| 2019/0135311 | A1* | 5/2019 | Zarella | B61L 15/0072 |
| 2019/0297526 | A1* | 9/2019 | Das | H04W 28/0289 |
| 2020/0344820 | A1* | 10/2020 | Fowe | G08G 1/0112 |

* cited by examiner 312
310
308
308
308

COMMUNICATION SYSTEM AND METHOD OF A VEHICLE CONSIST

CROSS-REFERENCE TO RELATED APPLICATIONS

This application is a continuation-in-part of U.S. patent application Ser. No. 16/193,783 (filed 16 Nov. 2018, now U.S. Pat. No. 11,142,221), which is a continuation of U.S. patent application Ser. No. 15/226,953 (filed 3 Aug. 2016, now U.S. Pat. No. 10,173,698), which is a continuation-in-part of U.S. patent application Ser. No. 14/881,445 (filed 13 Oct. 2015, now U.S. Pat. No. 9,862,392), which is a continuation-in-part of U.S. patent application Ser. No. 14/616,795 (filed 9 Feb. 2015). U.S. patent application Ser. No. 15/226,953 also is a continuation-in-part of U.S. patent application Ser. No. 15/159,893 (filed 20 May 2016, now U.S. Pat. No. 9,963,154). The entire disclosure of each of these applications is incorporated herein by reference.

FIELD

Embodiments of the inventive subject matter described herein relate to communications between vehicles in a vehicle consist and/or communications with the vehicle consists and other locations (e.g., off-board locations).

BACKGROUND

Some known vehicle consists include several propulsion-generating vehicles that generate tractive effort for propelling the vehicle consists along a route. For example, trains may have several locomotives coupled with each other that propel the train along a track. The locomotives may communicate with each other to coordinate the tractive efforts and/or braking efforts provided by the locomotives. As one example, locomotives may be provided in a distributed power (DP) arrangement with one locomotive designated as a lead locomotive and other locomotives designated as remote locomotives. The lead locomotive may direct the tractive and braking efforts provided by the remote locomotives during a trip of the consist.

A distributed power train may include multiple motive groups distributed over a length of the train. For example, a distributed power train may include a lead locomotive, an intermediate locomotive separated from the lead locomotive by one or more non-powered train cars, and a rear locomotive separated from the intermediate locomotive by one or more non-powered train cars. The trailing locomotives may be remote vehicles that may be controlled (for example, tractive and braking efforts) from the lead locomotive. As such, a distributed power train may include multiple locomotive groups, each of which may include a single locomotive or multiple locomotives forming a consist, all of which may be controlled from a lead locomotive group. Although in at least one embodiment, the powered locomotives may be located only at the front and rear ends of a train (they could work then in a push/pull configuration for the same subgroup of unpowered vehicles).

Some known consists use wireless communication between the locomotives for coordinating the tractive and/or braking efforts. For example, a lead locomotive may issue commands to the remote locomotives. The remote locomotives receive the commands and implement the tractive efforts and/or braking efforts directed by the commands.

Before the remote vehicles will operate according to command messages received from a lead locomotive, however, communication links between the lead locomotive and the remote locomotive may need to be established. A communication "handshake" between the lead and remote locomotives may need to occur so that the remote locomotives may identify the lead locomotive, the lead locomotive may identify the remote locomotives, and the remote locomotives may determine that forthcoming command messages are received from the lead locomotive and not from another locomotive. To establish the communication links used to remotely control the remote locomotives from the lead locomotive, some known systems require an operator to go onboard each of the remote locomotives, manually input information about the lead locomotive and/or remote locomotives, and initiate communication of one or more wireless messages from the remote locomotives to the lead locomotive. In some vehicle consists having many remote locomotives, requiring an operator to enter onboard and manually enter this type of information onboard each remote locomotive may be very time-consuming and susceptible to human errors in entering the correct information. As a result, considerable time and effort may be expended in establishing communication links between the lead and remote locomotives in a vehicle consist.

The remote locomotive group(s) of a distributed power train system may be oriented with respect to the same or an opposite direction from the lead group. That is, while the lead locomotive may face forward toward a direction of travel, one or more of the remote locomotive groups(s) may face rearward away from the direction of travel. To link the separate locomotive groups together, the direction of the remote locomotive group(s) relative to the lead locomotive group is determined so that control of all the locomotives may be coordinated. The lead and remote locomotive groups typically communicate via radio messages.

In a typical distributed power train system, an individual physically inspects and visually confirms the orientation of the remote powered locomotive(s) relative to the lead locomotive. After determining the orientation of the remote powered locomotive(s), the individual manually inputs the orientation data into a control system. The process of individually inspecting the powered locomotives and manually entering orientation data is time and labor intensive and may be susceptible to error. It may be desirable to have a system and method that differs from those that are currently available.

BRIEF DESCRIPTION

In one embodiment, a method (e.g., for communicatively linking vehicles in a vehicle consist) includes determining a vehicle identifier for a first remote vehicle included in a vehicle consist formed from a lead vehicle and at least the first remote vehicle, communicating a linking message addressed to the vehicle identifier from the lead vehicle to the first remote vehicle, and establishing a communication link between the lead vehicle and the first remote vehicle responsive to receipt of the linking message at the first remote vehicle. The communication link may be established such that movement of the first remote vehicle is remotely controlled from the lead vehicle via the communication link. The communication link may be established without an operator entering the first remote vehicle. The messages may be communicated via wired and/or wireless connections.

In another embodiment, a system (e.g., a communication system) includes a control unit and a communication unit. The control unit may determine a vehicle identifier for a first remote vehicle included in a vehicle consist formed from a lead vehicle and at least the first remote vehicle. The communication unit may communicate a linking message addressed to the vehicle identifier from the lead vehicle to the first remote vehicle. The communication unit may establish a communication link between the lead vehicle and the first remote vehicle responsive to receipt of the linking message at the first remote vehicle. The control unit may remotely control movement of the first remote vehicle from the lead vehicle via the communication link. The communication link may be established without an operator entering the first remote vehicle.

In another embodiment, a method (e.g., for communicatively linking vehicles in a vehicle consist) includes receiving unique or specific vehicle identifiers of remote vehicles included in a vehicle consist with a lead vehicle, communicating linking messages with the unique vehicle identifiers to the remote vehicles, and responsive to the unique vehicle identifiers in the linking messages matching the remote vehicles in the vehicle consist, establishing one or more communication links between the lead vehicle and the remote vehicles to permit the lead vehicle to remotely control movement of the remote vehicles included in the vehicle consist. The one or more communication links are established without an operator being onboard the remote vehicles to communicate responsive messages from the remote vehicles to the lead vehicle.

In another embodiment, a method (e.g., for communicatively linking vehicles in a vehicle consist) includes determining a first unique vehicle identifier for a first remote vehicle and a second unique vehicle identifier for a second remote vehicle included in a vehicle consist formed from a lead vehicle, the first remote vehicle, and the second remote vehicle, detecting a single instance of an operator actuating an input device onboard the lead vehicle, communicating from the lead vehicle a first wireless linking message addressed to the first unique vehicle identifier to the first remote vehicle and communicating a second wireless linking message addressed to the second unique vehicle identifier to the second remote vehicle responsive to detecting the single instance of the operator actuating the input device, establishing a first communication link between the lead vehicle and the first remote vehicle responsive to receipt of the first wireless linking message at the first remote vehicle and a second communication link between the lead vehicle and the second remote vehicle responsive to receipt of the second wireless linking message at the second remote vehicle (where the communication link is established without an operator entering the first remote vehicle or the second remote vehicle), and remotely controlling movement of the first remote vehicle and the second remote vehicle from the lead vehicle via the first communication link and the second communication link, respectively. Communicating the wireless linking message may include broadcasting the first wireless linking message and the second wireless linking message such that the first remote vehicle receives the first wireless linking message and the second remote vehicle receives the second wireless linking message and at least one other remote vehicle that is located within a wireless communication range of the lead vehicle but that is not included in the vehicle consist receives at least one of the first wireless linking message or the second wireless linking message. Establishing the first communication link between the lead vehicle and the first remote vehicle and the second communication link between the lead vehicle and the second remote vehicle may include preventing the at least one other remote vehicle from establishing a communication link with the lead vehicle based at least in part on the first unique vehicle identifier or the second unique vehicle identifier.

In another embodiment, a method (e.g., for communicatively linking vehicles in a vehicle system) includes receiving, at an energy management system disposed onboard a vehicle system formed from a lead vehicle and one or more remote vehicles, trip data that represents one or more characteristics of an upcoming trip of the vehicle system along a route and communicating a selected portion of the trip data from the energy management system to a distributed power system disposed onboard the vehicle system. The selected portion includes identifying information and one or more orientations of the one or more remote vehicles. The method includes establishing, using the distributed power system, wireless communication links between the lead vehicle and the one or more remote vehicles using the identifying information and the one or more orientations.

In another embodiment, a system (e.g., a communication system) includes an energy management system and a control unit. The energy management system may be disposed onboard a vehicle system formed from a lead vehicle and one or more remote vehicles. The energy management system may receive trip data that represents one or more characteristics of an upcoming trip of the vehicle system along a route. The control unit may be disposed onboard the vehicle system and may establish wireless communication links between the lead vehicle and the one or more remote vehicles. The energy management system may communicate a selected portion of the trip data to the control unit. The selected portion includes identifying information and one or more orientations of the one or more remote vehicles. The control unit may establish the wireless communication links using the identifying information and the one or more orientations.

Certain embodiments of the present disclosure provide a system that includes a lead powered vehicle including a first directional sensor that may output a first directional signal indicative of a first heading of the lead powered vehicle. A remote powered vehicle including a second directional sensor may output a second directional signal indicative of a second heading of the remote powered vehicle. The lead powered vehicle controls operation of the remote powered vehicle. A heading determination unit includes a communication interface and a controller. The communication interface may receive the first and second directional signals. The controller may determine an orientation for the second heading based on the first and second directional signals.

The heading determination unit may be onboard the lead powered vehicle. Alternatively, the heading determination unit may be remotely located from the vehicle system. In at least one embodiment, the heading determination unit compares the first directional signal with the second directional signal to determine the orientation of the second heading.

At least one of the first and second directional sensors may include a digital compass. Optionally, at least one of the first and second directional sensors may include a global positioning system (GPS) unit.

The remote powered vehicle may be directly coupled to the lead powered vehicle, thereby forming a consist. Optionally, at least one other vehicle may be connected between the lead powered vehicle and the remote powered vehicle.

In at least one embodiment, the lead powered vehicle is a lead locomotive on a track, and the remote powered vehicle is a remote locomotive on the track.

Certain embodiments of the present disclosure provide a method that includes disposing a first directional sensor onboard a lead powered vehicle, outputting (from the first directional sensor) a first directional signal indicative of a first heading of the lead powered vehicle, disposing a second directional sensor onboard a remote powered vehicle that is controlled by the lead powered vehicle, outputting (from the second directional sensor) a second directional signal indicative of a second heading of the remote powered vehicle, receiving the first and second directional signals at a heading determination unit, and determining (by the heading determination unit) an orientation for the second heading based on the first and second directional signals.

The method may include disposing the heading determination unit onboard the lead powered vehicle. Alternatively, the method may include remotely locating the heading determination unit from the vehicle system.

In at least one embodiment, the determining includes comparing the first directional signal with the second directional signal to determine the orientation of the second heading.

The method may include directly coupling the remote powered vehicle to the lead powered vehicle. Optionally, the method may include connecting at least one other vehicle between the lead powered vehicle and the remote powered vehicle.

Certain embodiments of the present disclosure provide a heading determination unit that includes a communication interface, and a controller operably coupled to the communication interface and having at least one processor. The communication interface may receive a first directional signal from a first directional sensor of a lead powered vehicle. The first directional signal is indicative of a first heading of the lead powered vehicle. The communication interface may receive a second directional signal from a second directional sensor of a remote powered vehicle. The second directional signal indicative of a second heading of the remote powered vehicle. The lead powered vehicle controls operation of the remote powered vehicle. The controller may determine an orientation for the second heading based on the first and second directional signals.

The communication interface and the controller may be disposed on board one of the lead powered vehicle and the remote powered vehicle. Each of the first directional sensor and the second directional sensor is one of a respective digital compass or a respective global positioning system (GPS) unit.

BRIEF DESCRIPTION OF THE DRAWINGS

Reference is now made briefly to the accompanying drawings, in which.

DETAILED DESCRIPTION

Figure 1:
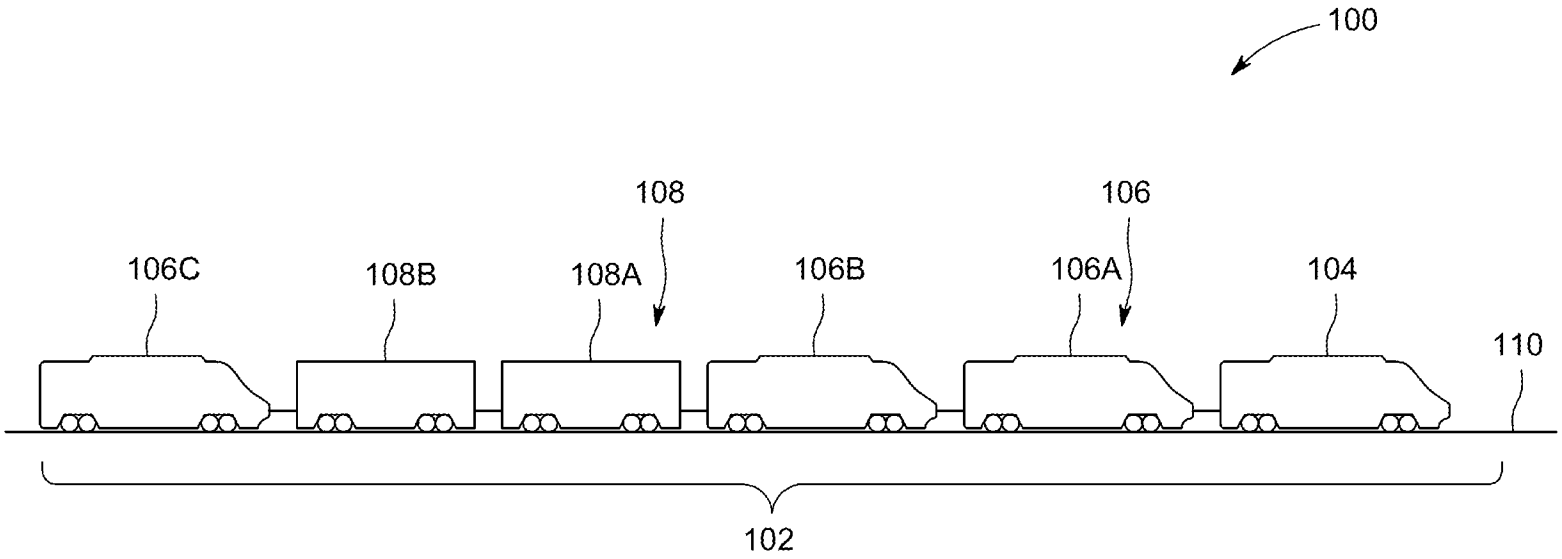
FIG. 1 illustrates one embodiment of a communication system of a vehicle consist or vehicle system.

One or more embodiments of the inventive subject matter described herein provides for methods and systems for communicating between devices onboard vehicles (e.g., propulsion-generating vehicles and/or non-propulsion-generating vehicles) in a vehicle consist. This subject matter may be used in connection with rail vehicles and rail vehicle consists, or alternatively may be used with other types of vehicles (e.g., automobiles, mining vehicles, agricultural vehicles, marine vessels, aircraft, etc.). The vehicle consist may include two or more vehicles mechanically coupled with each other to travel along a route together. Optionally, the vehicle consist may include two or more vehicles that are not mechanically coupled with each other, but the travel along a route together. For example, two or more automobiles may wirelessly communicate with each other as the vehicles travel along the route to coordinate movements with each other. The term consist, as used herein, denotes groups or subgroups of vehicles that move in a coordinated matter relative to each other. The term consist may be interchanged with cognates, such as platoon, swarm, fleet, and the like, depending on the phraseology associated with the particular vehicle type or industry.

In operation, a lead or controlling vehicle may obtain unique vehicle identifiers associated with the remote vehicles included in the same vehicle consist as the lead vehicle. The term lead does not mean that the vehicle is the first vehicle along a direction of travel among several vehicles, but rather indicates that the vehicle controls or directs operation of at least one other vehicle or one other device onboard another vehicle. The lead vehicle may be the first or leading vehicle among two or more vehicles along a direction of travel of the multiple vehicles, or the lead vehicle may not be the first or leading vehicle. Note that in at least one embodiment, the vehicle group may be controlled by an offboard, remote controller—and as such, the "lead vehicle" may be a stationary controller. As for the term "unique" that term is useful insofar as it is an identifier that specifically and unambiguously refers to a single piece of equipment. It does not preclude the dynamic assignation of identifiers to various pieces of equipment, merely that in any particular instance it only designates one item.

The vehicle identifiers may not include identifiers associated with remote vehicles that are not included in the vehicle consist. The vehicle identifiers may be obtained from a system such as a vehicle control system that restricts movement of vehicle consists based on locations of the vehicle consists. For example, such a system may include a positive train control (PTC) system, another positive control system that sends signals to vehicles to indicate whether the vehicles have permission to enter into various segments of routes, or a negative control system that sends signals to vehicles to indicate whether the vehicles are not allowed to enter into various segments of routes. Optionally, the vehicle identifiers may be obtained from an energy management system, such as a system that creates a trip plan that designates operational settings of the vehicle consist as a function of time and/or distance along a route to control movement of the vehicle consist. Additionally or alternatively, the vehicle identifiers of the remote vehicles in the vehicle consist may be manually input by an operator or obtained from another system, or obtained from another device onboard the vehicles, such as a head of vehicle device or end of vehicle device. Examples of such devices include a head of train (HOT) device and an end of train (EOT) device.

The controlling vehicle may communicate wireless linking messages to remote vehicles. The remote vehicles include one or more vehicles that receive instructions from the controlling vehicle and are at least partially remotely controlled by the controlling vehicle. The remote vehicles may trail the controlling vehicle along a direction of travel or one or more (or all) of the remote vehicles may be ahead of the controlling vehicle along the direction of travel. The remote vehicles optionally may be referred to as controlled vehicles. The linking messages may be addressed to the controlled vehicles using the vehicle identifiers. For example, the linking messages may include the vehicle identifiers. Vehicles that receive the linking messages other than the controlled vehicles in the consist may not be linked with the controlling vehicle due to the vehicle identifiers not matching or being associated with these other vehicles. For example, one or more of these other vehicles may be within a wireless communication range of the controlling vehicle and may receive the linking messages, but these other vehicles are not part of the same multi-vehicle system as the controlling vehicle. At the controlled vehicles that are included in the same vehicle consist or vehicle system as the controlling vehicle, the controlled vehicles may be communicatively linked with the controlling vehicle. For example, the controlled vehicles may communicate linking confirmation messages responsive to receiving the linking messages.

The remote or controlled vehicles may communicate these confirmation messages without an operator having to enter onboard the remote vehicles. For example, while an operator may be onboard the lead vehicle, the operator may not enter onboard any other vehicles in the vehicle consists or vehicle systems to establish communication links between the lead and remote vehicles in the vehicle consists. Upon receiving the confirmation messages at the lead vehicle, communication links between the lead and remote vehicles are established. Establishing these communication links allows for the lead vehicle to remotely control operations of the remote vehicles during movement of the vehicle consists along the route. For example, the lead vehicle may communicate wireless command messages to change throttle settings, brake settings, speeds, power outputs, or the like of the remote vehicles during movement of the vehicle consists. Other vehicles that do not have communication links established with the lead vehicle cannot be remotely controlled by the lead vehicle.

Certain embodiments of the disclosure provide a distributed power vehicle system in which one or more powered vehicles include a positional sensor, such as a digital compass sensor or global navigation satellite system (GNSS) receiver, such as a global positioning system (GPS) receiver or unit. Each positional sensor may be in communication with a vehicle direction detector (such as a heading determination unit), which may be onboard one or more of the powered vehicles. The vehicle direction detector may output vehicle heading data (such as in degrees) to a control system and/or a distributed power system, which may then compare heading information for the lead powered vehicle and the remote powered vehicle(s), such as through wireless communication devices.

In embodiments, system may include a controller having a local data collection system deployed that may use machine learning to enable derivation-based learning outcomes from computers without the need to program them. The controller may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. By way of this example, the machine learning systems may be used to perform intelligent computing based control and be responsive to tasks in a wide variety of systems. In examples, machine learning systems may be used in advanced computing applications. In an example, machine learning may be used for vehicle performance and behavior analytics, and the like).

In one embodiment, controller includes a policy engine that may apply one or more policies. These policies may be based at least in part on characteristics of a given item of equipment or environment. For example, a lead vehicle may have a policy that includes a policy that only a verifiably local controller can change certain parameters of the vehicle operation. This may, for example, avoid a remote "takeover" by a hacker. This may be accomplished in turn by automatically finding and applying security policies that bar connection of the control of the vehicle via the Internet, by requiring access authentication, or the like. The policy engine may include cognitive features, such as varying the application of policies, the configuration of policies, and the like (such as features based on state information from the state system). By variation and selection based on feedback, the policy engine can, over time, learn to automatically create, deploy, configure, and manage policies across very large numbers of vehicles, such as managing policies for configuration of connections.

In other embodiments, methods and systems are disclosed herein for a network-feedback collector, including a network condition-sensitive, self-organizing, multi-sensor data collector that can optimize aspects and features of the communication system based at least in part on bandwidth, quality of service, pricing and/or other network conditions. Network sensitivity can include awareness of the price of data transport (such as allowing the system to pull or push data during off-peak periods or within the available parameters of paid data plans), the quality of the network (such as to avoid periods where errors are likely), the quality of environmental conditions (such as delaying transmission until signal quality is good, such as when a collector emerges from a shielded environment (such as a tunnel or in dark territory), avoiding wasting use of power when seeking a signal when shielded, and the like. In one embodiment, the controller may establish geo-fencing zones and switch operating modes depending on its location relative to the geo-fence.

With respect to control policies, a neural network can receive input of a number of environmental and task-related parameters. These parameters may include an identification of a determined trip plan for a vehicle group, data from various sensors, and location and/or position data. The neural network can be trained to generate an output based on these inputs, with the output representing an action or sequence of actions that the vehicle group should take to accomplish the trip plan. During operation, a selection of an action can occur by processing the inputs through the parameters of the neural network to generate a value at the output node designating that action as the desired action. This action may translate into a signal that causes the vehicle operate. This may be accomplished via backpropagation. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the vehicle controller executes that plan to achieve the desired input data to mirror the predicted best outcome scenario. Suitable success metrics may include, for example, the lowest fuel or energy consumption to complete the trip plan, or the fastest through put to arrive at the destination, or the least expected wear or strain on the equipment, or the lowest likelihood of a collision (or derailment), and the like. Additionally, the success metric may be a combination of the foregoing, which may be weighed relative to each other (or with absolute limits—as fast as possibly with zero collisions, e.g.).

FIG. 1 illustrates one embodiment of a communication system 100 of a vehicle consist or vehicle system 102. The illustrated vehicle consist or group includes both propulsion-generating vehicles 104, 106 (e.g., vehicles 104, 106A, 106B, 106C) and non-propulsion-generating vehicles 108 (e.g., vehicles 108A, 108B) that travel together along a route 110. Although the vehicles are shown as being mechanically coupled with each other, optionally, the vehicles may not be mechanically coupled with each other. In one embodiment, the propulsion-generating vehicles may neighbor each other in the vehicle consist with no non-propulsion-generating vehicle disposed between the propulsion-generating vehicles. Optionally, two or more of the propulsion-generating vehicles may be separated from each other by at least one non-propulsion-generating vehicle.

The propulsion-generating vehicles are shown as locomotives, the non-propulsion-generating vehicles are shown as rail cars, and the vehicle consist is shown as a train in the illustrated embodiment. Alternatively, the vehicles may represent other vehicles, such as automobiles, marine vessels, or the like, and the vehicle consist may represent a grouping or coupling of these other vehicles. The number and arrangement of the vehicles in the vehicle consist are provided as one example and are not intended as limitations on all embodiments of the subject matter described herein.

In one embodiment, the group of vehicles may be referred to as a vehicle system, with groups of one or more adjacent or neighboring propulsion-generating vehicles being referred to as a vehicle consist. For example, the vehicles 104, 106A, 106B, 108A, 108B, and 106C may be referred to as a vehicle system with vehicles 104, 106A, 106B be referred to as a first vehicle consist of the vehicle system and the vehicle 106C referred to as a second vehicle consist in the vehicle system. Alternatively, the vehicle consists may be defined as the vehicles that are adjacent or neighboring to each other, such as a vehicle consist defined by the vehicles 104, 106A, 106B, 108A, 108B, 106C.

The propulsion-generating vehicles may be arranged in a distributed power (DP) arrangement. For example, the propulsion-generating vehicles may include a lead vehicle 104 that issues command messages to the other propulsion-generating vehicles 106A, 106B, 106C which are referred to herein as remote vehicles. The designations "lead" and "remote" are not intended to denote spatial locations of the propulsion-generating vehicles in the vehicle consist, but instead are used to indicate which propulsion-generating vehicle is communicating (e.g., transmitting, broadcasting, or a combination of transmitting and broadcasting) command messages and which propulsion-generating vehicles are being remotely controlled using the command messages. For example, the lead vehicle may or may not be disposed at the front end of the vehicle consist (e.g., along a direction of travel of the vehicle consist). Additionally, the remote vehicles need not be separated from the lead vehicle. For example, a remote vehicle may be directly coupled with the lead vehicle or may be separated from the lead vehicle by one or more other remote vehicles and/or non-propulsion-generating vehicles.

The command messages may include directives that direct operations of the remote vehicles. These directives may include propulsion commands that direct propulsion subsystems of the remote vehicles to move at a designated speed and/or power level, brake commands that direct the remote vehicles to apply brakes at a designated level, and/or other commands. The lead vehicle issues the command messages to coordinate the tractive efforts and/or braking efforts provided by the propulsion-generating vehicles to propel the vehicle consist along a route, such as a track, road, waterway, or the like.

The command messages may be communicated using the communication system 100. In one embodiment, the command messages are wirelessly communicated using the communication system. The communication system may include wireless transceiving hardware and circuitry disposed onboard two or more of the vehicles. Prior to the remote vehicles being remotely controlled by a lead vehicle in the vehicle consists, communication links may be established between the lead and remote vehicles.

To establish a communication link between a lead vehicle and a remote vehicle, the lead vehicle may wirelessly communicate a linking message to the remote vehicle. This linking message may include a unique code, such as a unique vehicle identifier, which is associated with the remote vehicle. This code may not be associated with or otherwise identify other remote vehicles in one embodiment. Alternatively, the vehicle identifier may identify or be associated with two or more remote vehicles, such as two or more remote vehicles that are the same type of vehicle, there included in the vehicle consists, or the like. At the remote vehicle that receives linking message, if the vehicle identifier in the linking message matches, is associated with, or otherwise identifies the remote vehicle, then the remote vehicle may communicate a confirmation message back to the lead vehicle. This confirmation message may be wirelessly communicated to the lead vehicle. The communication link between the lead and remote vehicles may be established responsive to the linking message being received by the remote vehicle and a confirmation message being received by the lead vehicle. Alternatively, the communication link between the lead and remote vehicles may be established once the linking message is received at the remote vehicles, without requiring a confirmation message from being received back at the lead vehicle.

The lead vehicle may determine vehicle identifiers for the remote vehicles by receiving a list of unique identifying codes associated with the remote vehicles in the vehicle consist. This list may be received from one or more systems other than the communication system, such as a vehicle control system that restricts movement of the vehicle consists based at least in part on the location of the vehicle consists. One example of such a vehicle control system includes a positive train control or PTC system. Another example of such a system may include an energy management system that creates a trip plan to control movement of the vehicle consist. The trip plan may designate operational settings of the vehicle consist as a function of time and/or distance along the route. The operational settings designated by the trip plan may reduce fuel consumed and/or emissions generated by the vehicle consist relative to the vehicle consist traveling according to other operational settings. For example, operating the vehicle consist according to the operational settings designated by the trip plan may reduce the fuel consumed and/or emissions generated by the vehicle consist relative to the same vehicle consist traveling over the same route for the same trip using different operational settings (e.g., those settings that cause the vehicle consist to travel at the upper speed limit or track speed of the route). Alternatively, the vehicle identifiers may be received from another type of system, such as a dispatch facility, a vehicle yard such as a rail yard, or the like. In one aspect, and operator may manually input the vehicle identifiers onboard the lead vehicle.

In contrast to some known systems, operators are not required to enter onboard the remote vehicles to identify these remote vehicles to the lead vehicle. Instead, the remote vehicles are identified by a separate system such that the operators do not need to enter onboard the remote vehicles to determine which remote vehicles are in the vehicle consist. As a result, communication links between the lead and remote vehicles may be established without requiring operators to enter onboard the remote vehicles. Consequently, considerable time and effort may be saved by avoiding requiring the operators to enter onboard the remote vehicles.

In at least one embodiment, each of the propulsion-generating vehicles 104, 106 may include a location determination device, which may include a positional sensor, such as a digital compass, GPS unit, or the like. In at least one embodiment, each location determination device is a compass.

The vehicle 104 provides a lead unit in a distributed power vehicle system. The vehicles 106A-C provide remote powered vehicles, each of which may be oriented the same or differently from the lead vehicle. The positional sensors onboard the vehicles output directional signals, which may include heading data, for each of the vehicles. The directional signals provide directional orientation information (for example, the direction in which a vehicle is facing) for the vehicles.

Figure 2:
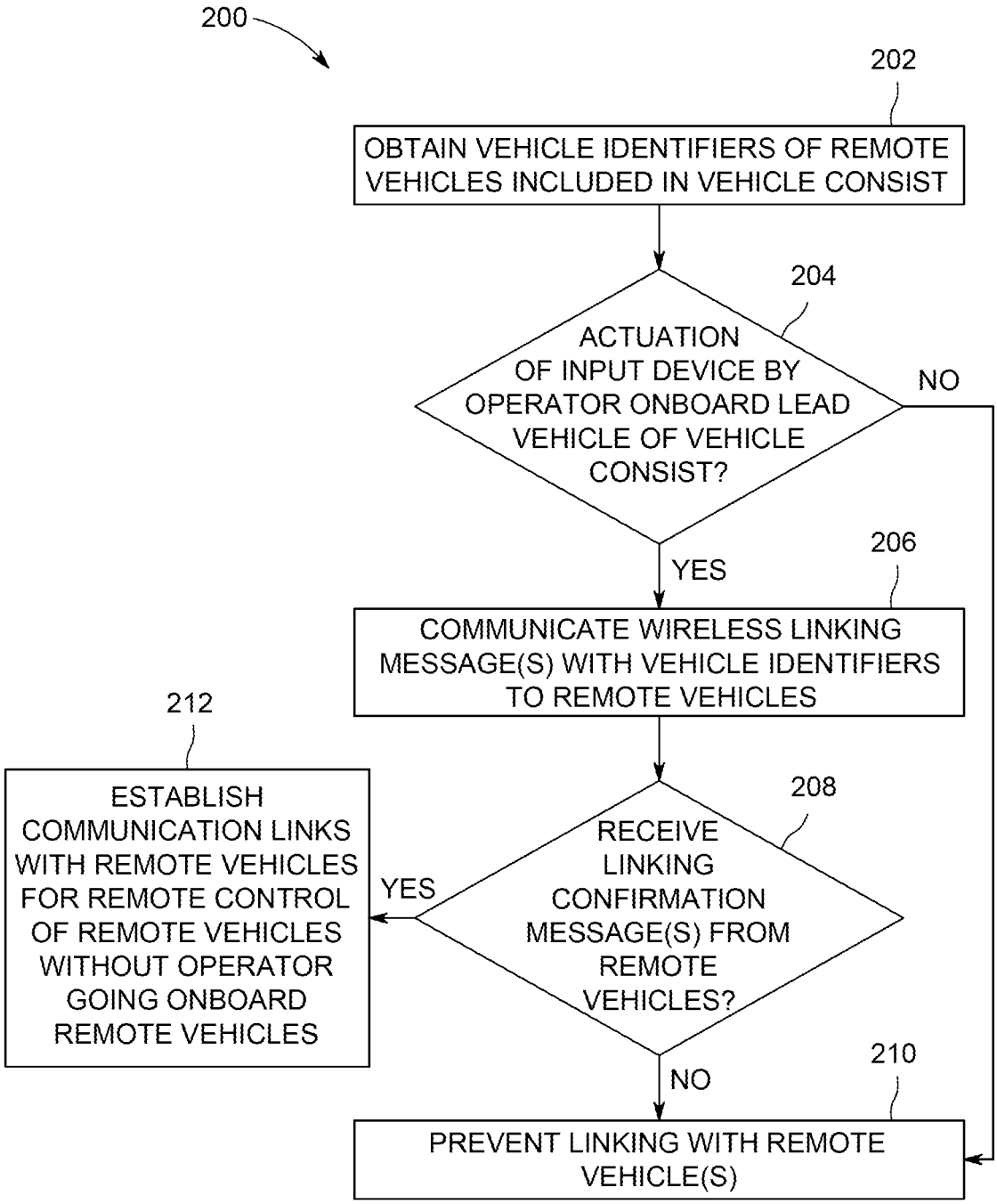
FIG. 2 illustrates a flowchart of one embodiment of a method for communicatively linking vehicles in a vehicle consist.

FIG. 2 illustrates a flowchart of one embodiment of a method 200 for communicatively linking vehicles in a vehicle consist. The method may be performed by communication system shown in FIG. 1. At step 202, the vehicle identifiers of remote vehicles included in the vehicle consist are obtained. The vehicle identifiers may be obtained from a system other than the communication system, such as a vehicle control system, energy management system, a dispatch facility, or the like. Optionally, the vehicle identifiers may be input by an operator onboard the lead vehicle. The vehicle identifiers that are obtained may be unique codes that uniquely identify the remote vehicles included in the vehicle consist, and that do not include vehicles that are not included in the vehicle consist. For example, the vehicles that are included in the vehicle consist may already be mechanically linked and/or otherwise positioned near one another to travel together along the route as a consist. The vehicle identifiers that are obtained may represent those vehicles in the consist, and not any vehicles not included in the consist.

In one aspect, the vehicle identifiers may be obtained in addition to orientations of the remote vehicles. The orientations may indicate the directions that the remote vehicles are facing in the vehicle consist, as described below. The vehicle identifiers and/or orientations may be obtained from data that is communicated from an off-board location to one or more onboard systems, such as an energy management system (as described below).

At step 204, a determination is made as to whether an input device onboard the lead vehicle of the vehicle consists has been actuated. For example, a determination may be made as to whether an operator has pressed a button, flip the switch, moved a lever, typed on a keyboard, touched a touch-sensitive display screen, spoken commands into a microphone, or the like. Actuation of an input device may indicate that the operator wishes to initiate establishment of the communication links between the lead and remote vehicles in the consist. For example, once the vehicle identifiers and/or orientations of the remote vehicles in the consist have been obtained, the operator onboard lead vehicle may press a single button (or otherwise perform a single actuation of an input device) to initiate the establishment of communication links between the lead and remote vehicles. Alternatively, the operator may actuate the same input device several times and/or may actuate multiple input devices to cause the linking messages to be sent. If the input device has been actuated, flow of the method may continue to step 206. On the other hand, if the input device is not actuated, then flow of the method may proceed to step 210, described below.

At step 206, linking messages are communicated to the remote vehicles in the consist. These linking messages may be wirelessly communicated from the lead vehicle to the remote vehicles. Linking messages may be addressed to the remote vehicles. For example, the linking messages may include the vehicle identifiers of the remote vehicles included in the consist. Different linking messages may be communicated to different remote vehicles. For example, a first linking message having a first vehicle identifier may be communicated to a first remote vehicle, a second linking message having a different, second vehicle identifier may be communicated to a different, second remote vehicle, and so on. Optionally, one or more linking messages may include multiple vehicle identifiers. For example, a linking message may be wirelessly communicated from the lead vehicle and may include the vehicle identifiers of the remote vehicles included in the vehicle consist.

Onboard the remote vehicles, if a linking message is received that includes a vehicle identifier that matches or otherwise corresponds with the remote vehicle receiving the linking message, the remote vehicle may communicate a linking confirmation message back to the lead vehicle. This confirmation message may be wirelessly communicated to the lead vehicle to indicate or confirm receipt of the linking message. The linking confirmation messages may be communicated from the remote vehicles to lead vehicles without operators having to go onboard the remote vehicles. For example, responsive to a remote vehicle receiving a linking message from the lead vehicle that includes the vehicle identifier of the remote vehicle, the remote vehicle may autonomously (e.g., without operator intervention) wirelessly communicate the linking confirmation message to lead vehicle. Alternatively, the remote vehicles may not communicate a linking confirmation message responsive to receiving the linking message.

At step 208, a determination is made as to whether a linking confirmation message is received at the lead vehicle from one or more of the remote vehicles in the vehicle consist. For example, the lead vehicle may determine if all remote vehicles included in the vehicle consist communicated linking confirmation messages responsive to communicating the linking messages. Receipt of the linking confirmation messages from all remote vehicles at the lead vehicle may indicate or confirm that the remote vehicles received the linking messages from the lead vehicle. Failure to receive linking confirmation messages or an absence of linking confirmation messages from all remote vehicles at the lead vehicle may indicate that one or more remote vehicles did not receive linking messages from the lead vehicle. In one aspect, the lead vehicle may re-communicate one or more additional linking messages to the remote vehicles from which the lead vehicle did not receive a linking confirmation message.

If it is determined that linking confirmation messages were received from all remote vehicles, then flow of the method may proceed to step 212. Alternatively, if linking confirmation messages were not received from the remote vehicles, then flow the method may proceed to step 210.

At step 210, communication linking between the lead and remote vehicles is prevented. For example, if the remote vehicles did not receive the linking messages, if the lead vehicle did not receive confirmation of receipt of the linking messages at the remote vehicles, and/or if an operator did not actuate any input device to initiate establishment of communication links between the lead and remote vehicles, the communication links between the lead vehicle and one or more remote vehicles may not be established. This may prevent communication links from being established between the lead and remote vehicles that are not included in the vehicle consist, prevent communication links from being established between the lead vehicle and remote vehicle that did not receive a linking message, and/or prevent communication links from being established between vehicles in the vehicle consist without the operator initiating formation of the communication links.

At step 212, communication links between the lead vehicle and the remote vehicles are established. These communication links allow for the lead vehicle to remotely control operations and movement of the remote vehicles. For example, the communication links may allow the lead vehicle to issue command messages to the remote vehicles. The command messages may direct the remote vehicles to change throttle settings, brake settings, accelerations, speeds, power outputs, or the like. Upon receipt of the command messages, the remote vehicles may implement the changes in operational settings dictated by the command messages.

A communication link may be established by the lead vehicle identifying which remote vehicles are included in the vehicle consist, communicating linking messages to those remote vehicles, and receiving confirmation that the linking messages are received at the remote vehicles. The failure of the lead vehicle to determine which remote vehicles are included in the vehicle consist, the failure of the lead vehicle to communicate linking messages to those remote vehicles, or the failure of lead vehicle to receive confirmation that linking messages were received at the remote vehicles may prevent communication links from being established between the lead and remote vehicles. Alternatively, the communication links may be established by the lead vehicle identifying which remote vehicles are included in the vehicle consist and communicating linking messages to those remote vehicles, regardless of whether confirmation that the linking messages were received remote vehicles is received lead vehicle. For example, the communication links may be established without the remote vehicles communicating linking confirmation messages and/or without the lead vehicle receiving linking confirmation messages.

A communication link may be defined by a communication handshake between lead and remote vehicles. For example, communication of a first message from a lead vehicle to remote vehicle (e.g., a linking message) followed by successful communication of a second message from the remote vehicle to lead vehicle (e.g., a linking confirmation message) may be a communication handshake that establishes a communication link. Optionally, the communication link may be established by a dedicated communications channel being used between the lead and remote vehicles. For example, a designated frequency or frequency band may define a communication link.

The communication links between the lead and remote vehicles may be established without an operator having to go onboard the remote vehicles. As described above, the operator may go onboard the lead vehicle and, once the lead vehicle has determined which remote vehicles are included in the vehicle consist, the lead vehicle may establish communication links with the remote vehicles without the operator or other operators having to go onboard the remote vehicles to communicate information from the remote vehicles to the lead vehicle. As a result, considerable time and effort may be saved in setting up a vehicle consist for travel.

Figure 3:
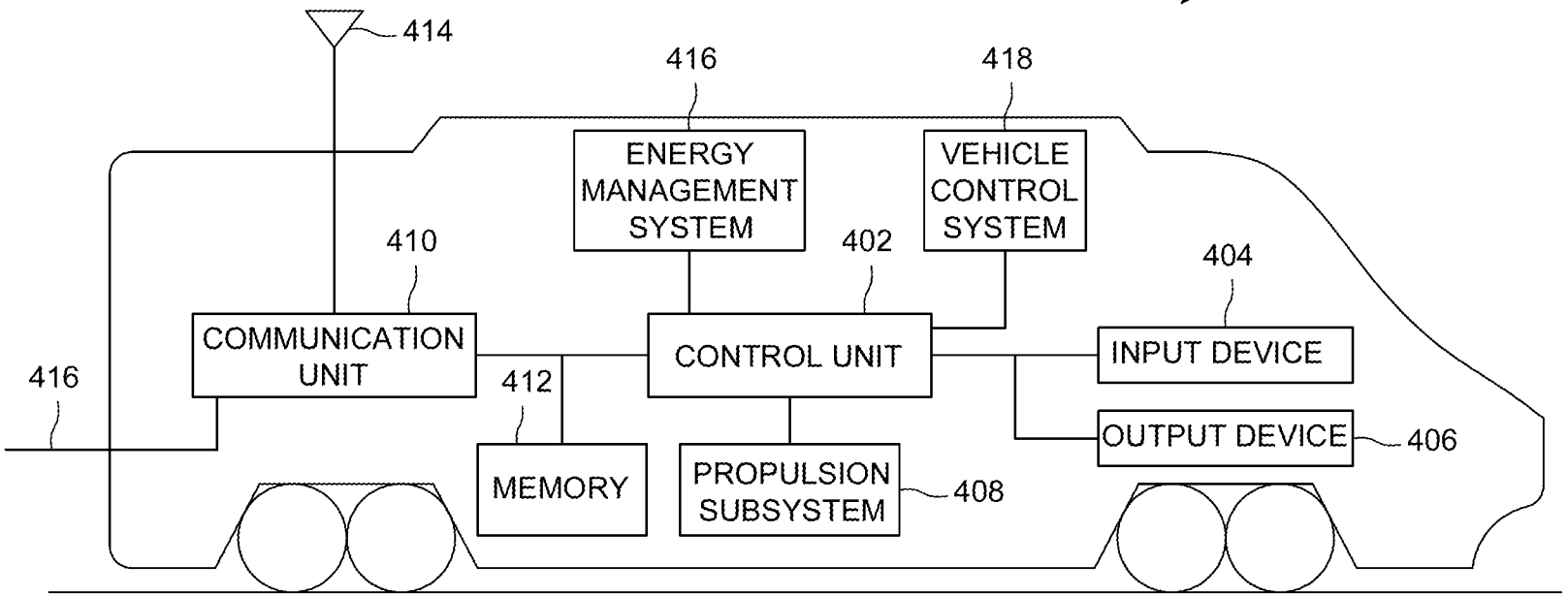
FIG. 3 is a schematic diagram of a propulsion-generating vehicle in accordance with one embodiment.

FIG. 3 is a schematic diagram of a propulsion-generating vehicle 400 in accordance with one embodiment. The vehicle may represent one or more of the vehicles shown in FIG. 1. The communication system shown in FIG. 1 may include one or more components onboard the vehicle shown in Figure that are used to establish communication links between the vehicle and one or more other vehicles in the same vehicle consist or vehicle system.

The vehicle includes a control unit 402 that controls operations of the vehicle. The control unit may include or represent one or more hardware circuits or circuitry that include, are connected with, or that both include and are connected with one or more processors, controllers, or other hardware logic-based devices. The control unit is connected with an input device 404 and an output device 406. The control unit may receive manual input from an operator of the propulsion-generating vehicle through the input device, such as a touchscreen, keyboard, electronic mouse, microphone, or the like. For example, the control unit may receive manually input changes to the tractive effort, braking effort, speed, power output, and the like, from the input device. The control unit may receive a single instance of an actuation of the input device to initiate the establishment of communication links between lead and remote vehicles in the vehicle consist. For example, instead of having one or more operators go onboard lead and remote vehicles of a consist in order to establish communication links for the remote control of the remote vehicles by the lead vehicles, an operator may go onboard the lead vehicle and press a single button or other input device to cause the lead vehicle to communicate linking messages to the remote vehicles in order to establish the communication links.

The control unit may present information to the operator using the output device, which may represent a display screen (e.g., touchscreen or other screen), speakers, printer, or the like. For example, the control unit may present the identities and statuses of the remote vehicles, identities of the missing remote vehicles (e.g., those remote vehicles from which the lead vehicle has not received the status), contents of one or more command messages, or the like.

The control unit is connected with a propulsion subsystem 408 of the propulsion-generating vehicle. The propulsion subsystem provides tractive effort and/or braking effort of the propulsion-generating vehicle. The propulsion subsystem may include or represent one or more engines, motors, alternators, generators, brakes, batteries, turbines, and the like, which operate to propel the propulsion-generating vehicle under the manual or autonomous control that is implemented by the control unit. For example, the control unit may generate control signals autonomously or based on manual input that is used to direct operations of the propulsion subsystem 408.

The control unit is connected with a communication unit 410 and a memory 412 of the communication system in the propulsion-generating vehicle. The memory may represent an onboard device that electronically and/or magnetically stores data. For example, the memory may represent a computer hard drive, random access memory, read-only memory, dynamic random access memory, an optical drive, or the like. The communication unit includes or represents hardware and/or software that is used to communicate with other vehicles in the vehicle consist or vehicle system. For example, the communication unit may include a transceiver and associated circuitry (e.g., antennas) 414 for wirelessly communicating (e.g., communicating and/or receiving) linking messages, command messages, linking confirmation messages, reply messages, retry messages, repeat messages, or the like. Optionally, the communication unit includes circuitry for communicating the messages over a wired connection 416, such as an electric multiple unit (eMU) line of the vehicle consist or system, catenary or third rail of electrically powered vehicle, or another conductive pathway between or among the propulsion-generating vehicles in the vehicle consist or vehicle system. The control unit may control the communication unit by activating the communication unit. The communication unit may examine the messages that are received by the vehicle. For example, the communication unit of a remote vehicle may examine received command messages to determine the directive sent by the lead vehicle. The directive may be conveyed to the control unit, which then implements the directive by creating control signals that are communicated to the propulsion subsystem for autonomous control or by presenting the directive to the operator on the output device for manual implementation of the directive.

The memory may store vehicle identifiers. In the lead vehicle, the memory may store the vehicle identifiers of the remote vehicles in the same consist or vehicle system as the lead vehicle. In the remote vehicles, the memory may store the vehicle identifier of the remote vehicle in which the memory is located (e.g., to allow the remote vehicle to communicate the vehicle identifier), the vehicle identifier of the lead vehicle (e.g., to allow the remote vehicle to verify that received messages are sent from the lead vehicle in the same consist), and/or other information.

The control unit may obtain the vehicle identifiers from another system, such as a vehicle control system 418, an energy management system 416, or another system. In one embodiment, one or more of the communication units in the vehicle consist or vehicle system is a head of vehicle or end of vehicle device, such as a HOT or EOT. The vehicle identifiers may be obtained from the head of vehicle and/or end of vehicle device. Optionally, the linking messages may be relayed by the head of vehicle and/or end of vehicle device. The vehicle control system shown in FIG. 3 may include hardware circuits or circuitry that include and/or are connected with one or more processors. The vehicle control system may control or limit movement of the vehicle and/or the vehicle consist or vehicle system that includes the vehicle based on one or more limitations. For example, the vehicle control system may prevent the vehicle and/or vehicle consist from entering into a restricted area, may prevent the vehicle and/or vehicle consist from exiting a designated area, may prevent the vehicle and/or vehicle consist from traveling at a speed that exceeds an upper speed limit, may prevent the vehicle and/or vehicle consist from traveling at a speed that is less than a lower speed limit, or the like. In one embodiment, the vehicle control system includes or represents a positive train control system. The vehicle control system may be programmed or otherwise have access to the vehicle identifiers of the vehicles included in the vehicle consist that includes the vehicle. For example, the vehicle control system may store right access to the vehicle identifiers so that the vehicle control system may determine how to control or limit control of the vehicle and/or the vehicle consist that includes the vehicle in order to prevent the vehicle and/or vehicle consist from violating one or more of the limits.

The energy management system may include an energy management controller, that itself may have hardware circuits or circuitry that include and and/or are connected with one or more processors. The energy management system may create a trip plans for trips of the vehicle and/or the vehicle consist or vehicle system that includes the vehicle. As described above, a trip plan may designate operational settings of the vehicle and/or the vehicle consist as a function of time and/or distance along a route for a trip. Traveling according to the operational settings designated by the trip plan may reduce fuel consumed and/or emissions generated by the vehicle and/or the vehicle consist relative to the vehicle and/or vehicle consist traveling according to other operational settings that are not designated by the trip plan. The energy management system may be programmed with or otherwise have access to the vehicle identifiers of the vehicles included in the vehicle consist. The identities of the vehicles in the consists may be known to energy management system 416 so that the energy management system may determine what operational settings to designate for a trip plan in order to achieve a goal of reducing fuel consumed and/or emissions generated by the consists during the trip.

One or more of the vehicle control system, the energy management system, or another system may communicate or otherwise provide the vehicle identifiers to the control unit and/or the communication unit. As described above, the communication unit and/or the control unit may communicate wireless linking messages that are addressed to the remote vehicles in the consist using the vehicle identifiers obtained from one or more of the systems.

Figure 4:
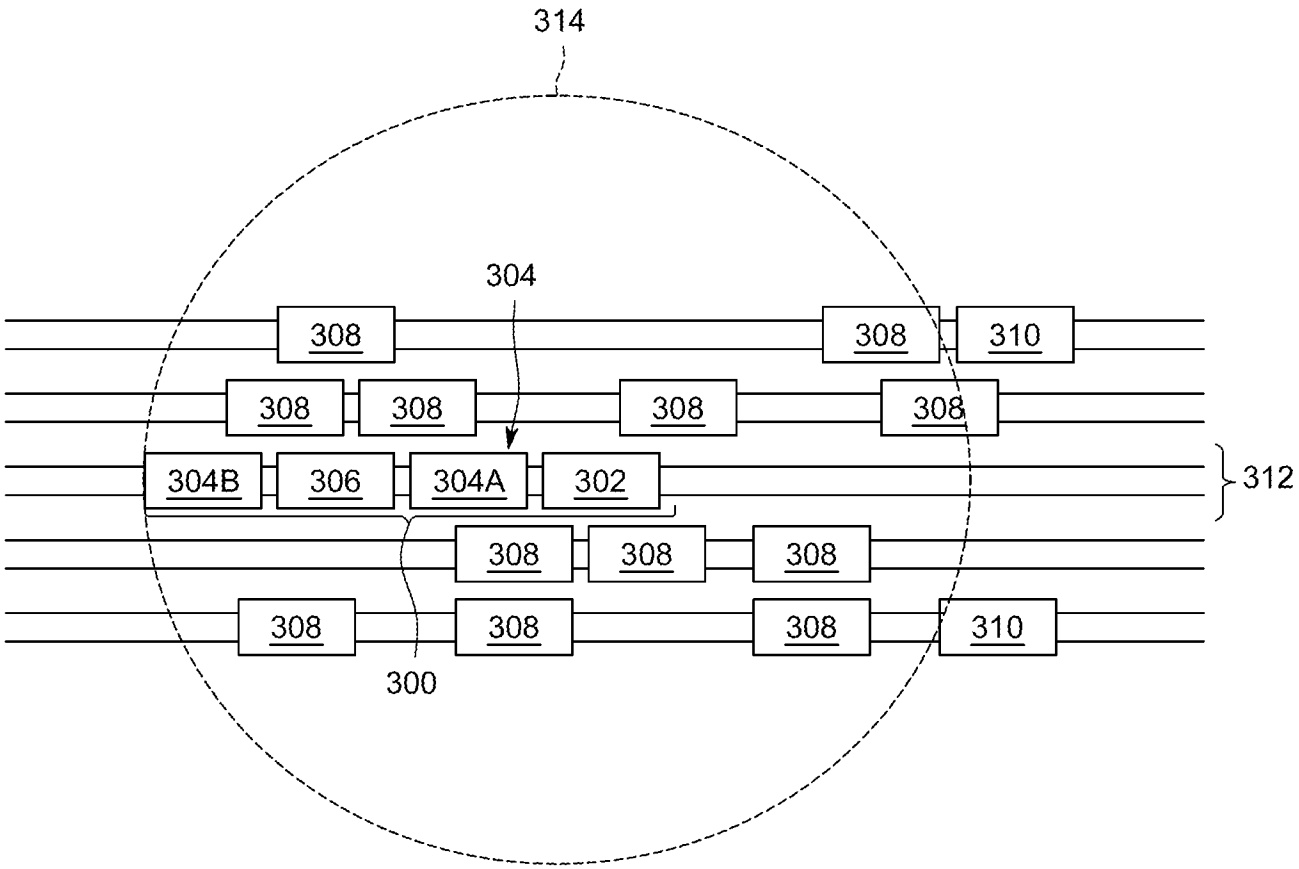
FIG. 4 illustrates several vehicles located on neighboring routes according to one example.

FIG. 4 illustrates several vehicles 302, 304 (e.g., 304A, 304B), 306, 308, 310 located on neighboring routes 312 according to one example. The vehicles 302, 304, 306, 308, 310 may represent one or more of the vehicles shown in FIGS. 1 and 3. The routes may be relatively close to one another, such as within five, ten, fifteen, twenty, twenty-five meters or another distance apart. For example, the routes may be neighboring tracks in a vehicle yard, such as a rail yard. Alternatively, the routes may be another type of route and/or another location.

The vehicles may be grouped together as a vehicle consist or vehicle system 300. For example, the vehicle 302 may represent the lead vehicle shown in FIG. 1, the vehicles 304A, 304B may represent remote vehicles shown in FIG. 1, and the vehicle 306 may represent a non-propulsion-generating vehicle shown in FIG. 1. Other vehicles 308, 310 shown in FIG. 4 are not included in the vehicle consist or vehicle system. For example, vehicles 308, 310 are not grouped with the vehicles 302, 304, 306 to travel with the vehicles 302, 304, 306 along a route. Instead, the vehicles 308, 310 may be included in another vehicle consist or may not be included in any vehicle consist.

The communication unit of the lead vehicle may have a wireless communication range 314. The range indicates how far wireless messages sent from the communication unit of the lead vehicle may be successfully communicated to another vehicle. In the illustrated example, the vehicles 304, 306, 308 are within the wireless range lead vehicle, while the vehicles 310 are outside of the wireless range the lead vehicle. As a result, wireless messages (such as wireless linking messages) communicated from the lead vehicle may be received by the vehicles 304, 306, 308, but not received by the vehicles 310. Optionally, one or more of the communication units onboard one or more of the vehicles may operate by repeating wireless messages or signals sent by the lead vehicle to effectively extend the wireless range of the lead vehicle (e.g., extend relative to the communication units not repeating the wireless messages or signals).

Communicating the wireless linking messages from the lead vehicle with the vehicle identifiers of the remote vehicles may prevent establishment of communication links with the vehicles that are within the wireless range of the lead vehicle, but that are not included in the vehicle consist or system of the lead vehicle. For example, one or more of the vehicles may receive a wireless linking message the lead vehicle. These vehicles may examine the vehicle identifier or vehicle identifiers included in the wireless linking message to determine if the vehicle identifier or identifiers in the wireless linking message matches the vehicle identifier associated with the vehicle. Because the vehicle identifiers in the wireless linking messages do not match or otherwise correspond with the vehicles, the vehicles may determine that the wireless linking messages are not addressed to the vehicles. As a result, the vehicles do not establish a communication link with the lead vehicle and/or do not respond to the wireless linking message with a linking confirmation message sent back to lead vehicle. Because the vehicle identifiers included in the linking message do match or otherwise correspond with the remote vehicles, these vehicles do establish communication link with the lead vehicle and/or establish the communication links by responding with a linking confirmation message.

The controllers onboard the vehicles that do not establish the communication link with the lead or controlling vehicle based on the vehicle identifiers not matching those in the linking message may determine that these vehicles are located on a different route than the lead or controlling vehicle. For example, a vehicle system including the lead vehicle may occupy a first route while the vehicles having identifiers that are not included in the linking messages may be on second, third, etc., routes. These vehicles may be within the wireless range of the lead vehicle but on different routes than the lead vehicle. Responsive to receiving a linking message, the controllers onboard the vehicles that receive the messages determine whether the vehicle identifier(s) included in the linking message match the identifier(s) of the vehicles. If there is a match between the identifier(s) in the message and the identifier of the vehicle that receives the message, then the controller of that vehicle can determine that the vehicle is on the same route as the lead vehicle. If there is not a match between the identifier(s) in the message and the identifier of the vehicle that receives the message, then the controller of that vehicle can determine that the vehicle is not on the same route as the lead vehicle. The controller can then control the vehicle accordingly. For example, if the controller determines that the vehicle is on the same route as the lead vehicle, then the controller can refrain or not move the vehicle to avoid a collision with the lead vehicle (or another vehicle in the vehicle system that includes the led vehicle). If the controller determines that the vehicle is not on the same route as the lead vehicle, then the controller can move the vehicle as the risk of collision with the vehicle system having the lead vehicle is reduced or eliminated.

In one embodiment, the data that is used by a distributed power system (for example, the control unit onboard the lead vehicle that establishes communication links for distributed power control) to establish the communication links may be obtained by another system onboard the vehicle consist. The onboard system of the lead vehicle may communicate with one or more off-board locations to wirelessly receive data signals from an off-board system that include consist makeup information. For example, the energy management system described herein may receive trip data for use in creating the trip plan described above. The trip data may include a variety of different types of information useful in creating the trip plan, such as locations or orders of the vehicles in the vehicle consist (e.g., positions along the length of the vehicle consist), an origin of the trip for which the trip plan is being created, a destination of the trip for which the trip plan is being created, weights of the vehicles in the vehicle consist, lengths of the vehicles in the vehicle consist, the number of propulsion-generating vehicles in the vehicle consist, the number of non-propulsion-generating vehicles in the vehicle consist, etc. The trip data may be communicated from an off-board system, such as a dispatch facility that wirelessly transmits or broadcasts the trip data to the energy management system.

In one embodiment, the trip data that is communicated to the energy management system from an off-board system may be modified to include additional or different types of information that the information described above. For example, the trip data may be modified by the off-board system to include additional information about the remote vehicles in the vehicle consist. This additional information may include the identifiers or identities of the remote vehicles in the vehicle consist and/or the orientation of the remote vehicles. The orientation of the remote vehicles may indicate the direction that each of the remote vehicles is facing. For example, the remote vehicles may be locally or remotely controlled to propel themselves in a forward direction or a rearward direction. Depending on the orientation of a remote vehicle, the movement of the remote vehicle in the forward direction or the rearward direction may cause the remote vehicle to move with or against other propulsion-generating vehicles in the vehicle consist. For example, if a remote vehicle has a first orientation such that the remote vehicle is facing a first direction (e.g., the short hood of a locomotive is facing east), then the remote vehicle will act to propel itself in the first direction when controlled to move in the forward direction and will act to propel itself in an opposite, second direction when controlled to move in the rearward direction. But, if the remote vehicle has an opposite, second orientation (e.g., the remote vehicle is facing the opposite, second direction), then the remote vehicle will act to propel itself in the second direction when controlled to move in the forward direction and act to propel itself in the first direction when controlled to move in the rearward direction. Not all of the remote vehicles may be oriented in the same direction in the vehicle consist. Some remote vehicles may be facing in one direction while one or more other remote vehicles face in an opposite direction.

The energy management system may create a trip plans for trips of the vehicle consist using the trip data that is received. In one aspect, the energy management system may not use all of the trip data to create the trip plan. For example, the energy management system may not use identities and/or orientations of the remote vehicles. The energy management system may communicate this part of the trip data to the control unit disposed onboard the lead vehicle of the vehicle consist. The energy management system may receive the trip data in several data packets (or another format) and extract or otherwise separate the remote vehicle identities and/or orientations from the other data included in the trip data. The energy management system may then generate the trip plan using the remaining data in the trip data (e.g., the trip data other than the remote vehicle identities and orientations). Alternatively, the energy management system may use the remote vehicle identities and/or orientations in generating the trip plan.

The energy management system may communicate the portion of the trip plan (e.g., the remote vehicle identities and/or orientations) to the control unit onboard the lead vehicle of the vehicle consist. This communication may occur automatically (e.g., without operator intervention) or in response to instructions or requests received from the operator. The control unit may then establish the communication links with the remote vehicles using the portion of the trip data received from the energy management system. For example, the control unit may display, on the output device, the remote vehicle identities and/or orientations. The operator onboard the lead vehicle may review and/or modify the identities and/or orientations (e.g., in a situation where the operator may see that an orientation or identity is incorrect) using the input device. The operator may then cause the control unit to create the communication links using the portion of the trip data (e.g., the remote vehicle identities and orientations). Similar to as described above, the operator may actuate the input device to cause the communication links to be established using the portion of the trip data, without the operator having to go onboard the remote vehicles.

In one aspect, the communication links between the lead and remote vehicles may not be established unless and until the orientations of the remote vehicles are known to (e.g., input into) the control unit. The control unit may not create the communication links until the orientations of the remote vehicles are known in order to prevent a remote vehicle having an opposite orientation than what is expected by the control unit of the lead vehicle from acting to propel the vehicle consist in an opposite direction than what is expected or desired or directed by the control unit of the lead vehicle.

In one embodiment, a method (e.g., for communicatively linking vehicles in a vehicle consist) includes determining a vehicle identifier for a first remote vehicle included in a vehicle consist formed from a lead vehicle and at least the first remote vehicle, communicating a wireless linking message addressed to the vehicle identifier from the lead vehicle to the first remote vehicle, and establishing a communication link between the lead vehicle and the first remote vehicle responsive to receipt of the wireless linking message at the first remote vehicle. The communication link may be established such that movement of the first remote vehicle is remotely controlled from the lead vehicle via the communication link. The communication link may be established without an operator entering the first remote vehicle.

Establishing the communication link may include receiving a wireless linking confirmation message from the first remote vehicle at the lead vehicle responsive to the wireless linking message being received at the first remote vehicle. Determining the vehicle identifier may include receiving a list of one or more unique identifying codes associated with at least the first remote vehicle from a vehicle control system that restricts movement of the vehicle consist based at least in part on a location of the vehicle consist.

The vehicle control system may include a positive train control system. Determining the vehicle identifier may include receiving a list of one or more unique identifying codes associated with at least the first remote vehicle from an energy management system that creates a trip plan to control movement of the vehicle consist. The trip plan may designate operational settings of the vehicle consist as a function of one or more of time or distance along a route.

In one aspect, the vehicle consist includes the lead vehicle, the first remote vehicle, and at least a second remote vehicle. Determining the vehicle identifier may include determining a first unique vehicle identifier for the first remote vehicle and at least a second unique vehicle identifier for at least the second remote vehicle. Communicating the wireless linking message may include communicating a first wireless linking message to the first remote vehicle and communicating at least a second wireless linking message to at least the second remote vehicle. Establishing the communication link may include establishing a first communication link between the lead vehicle and the first remote vehicle and at least a second communication link between the lead vehicle and at least the second remote vehicle.

The method may include detecting a single instance of an operator actuating an input device onboard the lead vehicle and communicating the first wireless linking message and the at least the second wireless linking message responsive to detecting the single instance of the operator actuating the input device. Communicating the wireless linking message may include broadcasting the wireless linking message such that the first remote vehicle receives the wireless linking message and at least one other remote vehicle that is located within a wireless communication range of the lead vehicle but that is not included in the vehicle consist receives the wireless linking message. Establishing the communication link between the lead vehicle and the first remote vehicle may include preventing the at least one other remote vehicle from establishing a communication link with the lead vehicle based at least in part on the vehicle identifier.

In one embodiment, a system (e.g., a communication system) includes a control unit and a communication unit. The control unit may determine a vehicle identifier for a first remote vehicle included in a vehicle consist formed from a lead vehicle and at least the first remote vehicle. The communication unit may communicate a wireless linking message addressed to the vehicle identifier from the lead vehicle to the first remote vehicle. The communication unit may establish a communication link between the lead vehicle and the first remote vehicle responsive to receipt of the wireless linking message at the first remote vehicle. The control unit may remotely control movement of the first remote vehicle from the lead vehicle via the communication link. The communication link may be established without an operator entering the first remote vehicle.

The communication unit may receive a wireless linking confirmation message from the first remote vehicle at the lead vehicle responsive to the wireless linking message being received at the first remote vehicle. The control unit may determine the vehicle identifier by receiving a list of one or more unique identifying codes associated with at least the first remote vehicle from a vehicle control system that restricts movement of the vehicle consist based at least in part on a location of the vehicle consist.

The vehicle control system may include a positive train control system. The control unit may determine the vehicle identifier by receiving a list of one or more unique identifying codes associated with at least the first remote vehicle from an energy management system that creates a trip plan to control movement of the vehicle consist. The trip plan may designate operational settings of the vehicle consist as a function of one or more of time or distance along a route.

The vehicle consist may include the lead vehicle, the first remote vehicle, and at least a second remote vehicle. The control unit may determine the vehicle identifier by determining a first unique vehicle identifier for the first remote vehicle and at least a second unique vehicle identifier for at least the second remote vehicle. The communication unit may communicate the wireless linking message by communicating a first wireless linking message to the first remote vehicle and communicating at least a second wireless linking message to at least the second remote vehicle. The communication unit may establish the communication link by establishing a first communication link between the lead vehicle and the first remote vehicle and at least a second communication link between the lead vehicle and at least the second remote vehicle.

The control unit may detect a single instance of an operator actuating an input device onboard the lead vehicle and the communication unit may communicate the first wireless linking message and the at least the second wireless linking message responsive to the control unit detecting the single instance of the operator actuating the input device. The communication unit may communicate the wireless linking message by broadcasting the wireless linking message such that the first remote vehicle receives the wireless linking message and at least one other remote vehicle that is located within a wireless communication range of the communication unit but that is not included in the vehicle consist receives the wireless linking message. The communication unit may prevent the at least one other remote vehicle from establishing a communication link with the lead vehicle based at least in part on the vehicle identifier.

In one embodiment, a method (e.g., for communicatively linking vehicles in a vehicle consist) includes receiving unique vehicle identifiers of remote vehicles included in a vehicle consist with a lead vehicle, communicating linking messages with the unique vehicle identifiers to the remote vehicles, and responsive to the unique vehicle identifiers in the linking messages matching the remote vehicles in the vehicle consist, establishing one or more communication links between the lead vehicle and the remote vehicles to permit the lead vehicle to remotely control movement of the remote vehicles included in the vehicle consist. The one or more communication links are established without an operator being onboard the remote vehicles to communicate responsive messages from the remote vehicles to the lead vehicle.

Establishing the one or more communication links may include receiving one or more linking confirmation messages from the remote vehicles at the lead vehicle responsive to the linking messages being received at the remote vehicles without the operator being onboard the remote vehicles. Determining the vehicle identifiers may include receiving a list of one or more unique identifying codes associated with the remote vehicles from one or more of a vehicle control system that restricts movement of the vehicle consist based at least in part on a location of the vehicle consist and/or an energy management system that creates a trip plan to control movement of the vehicle consist. The trip plan may designate operational settings of the vehicle consist as a function of one or more of time or distance along a route.

The method may include detecting a single instance of an operator actuating an input device onboard the lead vehicle and communicating the linking messages occurs responsive to detecting the single instance of the operator actuating the input device.

In one embodiment, a method (e.g., for communicatively linking vehicles in a vehicle consist) includes determining a first unique vehicle identifier for a first remote vehicle and a second unique vehicle identifier for a second remote vehicle included in a vehicle consist formed from a lead vehicle, the first remote vehicle, and the second remote vehicle, detecting a single instance of an operator actuating an input device onboard the lead vehicle, communicating from the lead vehicle a first wireless linking message addressed to the first unique vehicle identifier to the first remote vehicle and communicating a second wireless linking message addressed to the second unique vehicle identifier to the second remote vehicle responsive to detecting the single instance of the operator actuating the input device, establishing a first communication link between the lead vehicle and the first remote vehicle responsive to receipt of the first wireless linking message at the first remote vehicle and a second communication link between the lead vehicle and the second remote vehicle responsive to receipt of the second wireless linking message at the second remote vehicle (where the communication link is established without an operator entering the first remote vehicle or the second remote vehicle), and remotely controlling movement of the first remote vehicle and the second remote vehicle from the lead vehicle via the first communication link and the second communication link, respectively. Communicating the wireless linking message may include broadcasting the first wireless linking message and the second wireless linking message such that the first remote vehicle receives the first wireless linking message and the second remote vehicle receives the second wireless linking message and at least one other remote vehicle that is located within a wireless communication range of the lead vehicle but that is not included in the vehicle consist receives at least one of the first wireless linking message or the second wireless linking message. Establishing the first communication link between the lead vehicle and the first remote vehicle and the second communication link between the lead vehicle and the second remote vehicle may include preventing the at least one other remote vehicle from establishing a communication link with the lead vehicle based at least in part on the first unique vehicle identifier or the second unique vehicle identifier.

In one embodiment, a method (e.g., for communicatively linking vehicles in a vehicle system) includes receiving, at an energy management system disposed onboard a vehicle system formed from a lead vehicle and one or more remote vehicles, trip data that represents one or more characteristics of an upcoming trip of the vehicle system along a route and communicating a selected portion of the trip data from the energy management system to a distributed power system disposed onboard the vehicle system. The selected portion includes identifying information and one or more orientations of the one or more remote vehicles. The method includes establishing, using the distributed power system, wireless communication links between the lead vehicle and the one or more remote vehicles using the identifying information and the one or more orientations.

The energy management system that receives the trip data may generate a trip plan for the upcoming trip of the vehicle using the trip data, the trip plan designating operational settings of the lead and remote vehicles. Movement of the one or more remote vehicles may be remotely controlled from the lead vehicle using the operational settings designated by the trip plan by wirelessly communicating control signals from the lead vehicle to the one or more remote vehicles via the wireless communication links.

The trip plan may designate the operational settings of the lead and remote vehicles as a function of one or more of time or distance along the route in order to reduce one or more of fuel consumed or emissions generated by the lead and remote vehicles relative to the lead and remote vehicles completing the upcoming trip using different operational settings than the operational settings designated by the trip plan. The trip data may include an origin location of the trip, a destination location of the trip, the identifying information of the one or more remote vehicles, the one or more orientations of the one or more remote vehicles, order information of the one or more remote vehicles, and one or more speed restrictions of the route.

Communicating the selected portion of the trip data and establishing the wireless communication links may occur automatically without operator intervention. Establishing the wireless communication links may be completed prior to generating the trip plan. The trip data may be wirelessly received at the energy management system from a location disposed off-board the vehicle system. The trip plan may be generated without using the one or more orientations of the one or more remote vehicles.

In one embodiment, a system (e.g., a communication system) includes an energy management system and a control unit. The energy management system may be disposed onboard a vehicle system formed from a lead vehicle and one or more remote vehicles, the energy management system may receive trip data that represents one or more characteristics of an upcoming trip of the vehicle system along a route. The control unit may be disposed onboard the vehicle system and to establish wireless communication links between the lead vehicle and the one or more remote vehicles. The energy management system may communicate a selected portion of the trip data to the control unit. The selected portion includes identifying information and one or more orientations of the one or more remote vehicles. The control unit may establish the wireless communication links using the identifying information and the one or more orientations.

The energy management system may generate a trip plan for the upcoming trip of the vehicle using the trip data. The trip plan designates operational settings of the lead and remote vehicles. The control unit may remotely control movement of the one or more remote vehicles using the operational settings designated by the trip plan by wirelessly communicating control signals from the lead vehicle to the one or more remote vehicles via the wireless communication links. The trip plan may designate the operational settings of the lead and remote vehicles as a function of one or more of time or distance along the route in order to reduce one or more of fuel consumed or emissions generated by the lead and remote vehicles relative to the lead and remote vehicles completing the upcoming trip using different operational settings than the operational settings designated by the trip plan.

The trip data may include an origin location of the trip, a destination location of the trip, the identifying information of the one or more remote vehicles, the one or more orientations of the one or more remote vehicles, order information of the one or more remote vehicles, and one or more speed restrictions of the route. The energy management system may communicate the selected portion of the trip data to the control unit and the control unit may establish the wireless communication links automatically without operator intervention. The control unit may establish the wireless communication links prior to the energy management system generating the trip plan.

The energy management system may wirelessly receive the trip data from a location disposed off-board the vehicle system. The energy management system may generate the trip plan without using the one or more orientations of the one or more remote vehicles.

Figure 5:
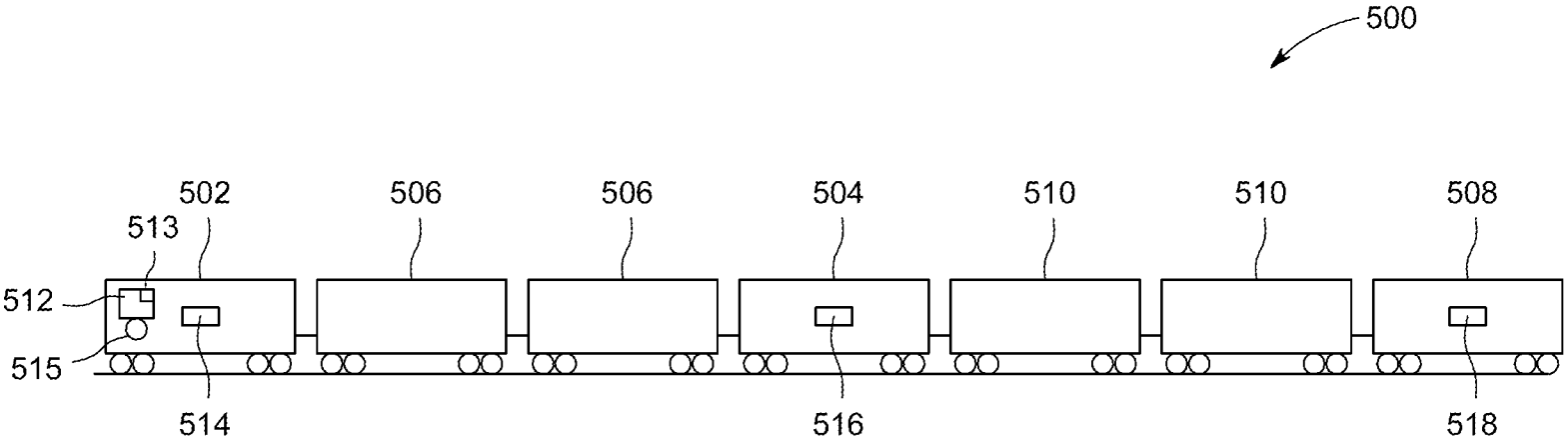
FIG. 5 illustrates a simplified schematic diagram of a distributed power vehicle system, according to an embodiment of the present disclosure.

FIG. 5 illustrates a simplified schematic diagram of a distributed power vehicle system 500, according to an embodiment of the present disclosure. The distributed power vehicle system includes a lead powered vehicle 502 separated from an intermediate powered vehicle 504 by one or more non-powered vehicles 506. The intermediate powered vehicle is separated from a rear powered vehicle by a plurality of non-powered vehicles 510. The lead, intermediate, and rear powered vehicles may each include one or more powered vehicles. For example, each of the lead, intermediate, and rear powered vehicles may include a plurality of vehicles forming a consist or a vehicle system (e.g., a multi-vehicle system). The intermediate and rear powered vehicles are remote powered vehicles in relation to the lead powered vehicle, as the lead powered vehicle remotely controls operation of the intermediate and rear powered vehicles.

The term powered may indicate that the corresponding vehicle is a propulsion-generating vehicle while the term non-powered may indicate that the corresponding vehicle is a non-propulsion-generating vehicle, even though the non-powered vehicle may receive and/or generate electric energy or current for powering one or more loads onboard the non-powered vehicle. Alternatively, the term non-powered vehicle indicates that the vehicle does not include any loads and/or does not generate electric energy or current.

Direction orientations for each of the vehicles is determined by a heading determination unit 512 (which may include one or more computers, processors, or the like) that is in communication with each of the intermediate and rear powered vehicles through wireless connections, for example. In at least one embodiment, the heading determination unit is a separate and distinct control unit. In at least one other embodiment, the heading determination unit is part of another system of the distributed power vehicle system, such as a distributed power control unit, an energy management system, a route guidance system, a handling unit, and/or the like. While shown onboard the lead powered vehicle, the heading determination unit may be onboard various other vehicles within the distributed power vehicle system. In at least one other embodiment, the heading determination unit may be remotely located from any of the vehicles of the distributed power vehicle system. The distributed power vehicle system may include more or fewer powered and unpowered vehicles than shown. The heading determination unit can represent or be included in a head of vehicle device and/or an end of vehicle device, such as a HOT device or an EOT device.

Each of the powered vehicles includes a location determination device or directional sensor or the like. The directional sensor may output a signal that indicates a directional orientation. A suitable directional sensor may include one or more of a compass, inertial sensor, GNSS unit (e.g., GPS unit), and the like. For example, the powered vehicle 502 includes an onboard directional sensor 514 (such as a digital compass, GPS unit, or the like), while the intermediate powered vehicle 504 includes an onboard directional sensor 516, and the rear powered vehicle 508 includes an onboard directional sensor 518. Each directional sensor is in communication with the heading determination unit, such as through wireless connections.

The heading determination unit may include a controller 513 that is operably coupled to a communication device 515, such as the communication unit shown in FIG. 4. The controller may be a control unit, such as one or more processors, or the like. The communication interface receives directional data from the directional sensors onboard the distributed power vehicle system. The directional data is indicative of directional orientations of the powered vehicles.

In operation, each directional sensor outputs a directional signal (which provides information as to the directional orientation, such as a heading) related to the respective powered vehicles. For example, the directional sensor onboard the lead powered vehicle outputs a directional signal indicative of the directional heading of the lead powered vehicle. Similarly, the directional sensor onboard the intermediate powered vehicle outputs a directional signal indicative of the directional heading of the intermediate powered vehicle. Further, the directional sensor onboard the rear powered vehicle outputs a directional signal indicative of the directional heading of the rear powered vehicle. The heading determination unit receives the directional signals from each of the directional sensors, such as through wireless connections (which may or may not extend through an end of vehicle or head of vehicle device). In this manner, the heading determination unit determines a heading (that is, a direction of orientation, such as forward towards the lead powered vehicle or rearwards in an opposite direction from that of the lead powered vehicle) for each of the powered vehicles of the distributed power vehicle system.

Through the directional signals output by each of the directional sensors, distributed power data output by each of the powered vehicles to the heading determination unit includes directional data. The heading determination unit onboard the lead powered vehicle receives the directional signals output by each of the directional sensors and compares the directional data of the directional signals for each of the powered vehicles. In this manner, the heading determination unit determines the heading or facing direction for each of the remote powered vehicles, as well as the lead powered vehicle.

In general, heading or facing directions for vehicles within a distributed power system are binary, such that each of the remote powered vehicles may face the same direction (for example, forward towards a direction of travel) or an opposite direction (for example, rearward opposite to the directional of travel) in relation to the lead powered vehicle. As such, when facing the same direction, the directional signals received from the remote powered vehicles are the same, or within a determined difference (that is, substantially the same) to the directional signal of the lead powered vehicle. If the remote powered vehicles are orientated in an opposite direction (that is, facing opposite from the front facing lead powered vehicle), the received directional signals from the remote powered vehicles are opposite, or within a determined opposite difference (that is, substantially opposite) to the directional signal of the lead powered vehicle.

Yard locations in which distributed power vehicle systems may link together may not be perfectly straight or linear, but may rarely include a degree of curvature approaching ninety degrees. As such, a suitable determined (or opposite) difference may be less than or equal to a difference of between five to ten degrees, for example. Alternatively, the determined (or opposite) difference may be less than five degrees, or greater than ten degrees as may be determined with reference to application specific parameters.

In at least one embodiment, after the heading determination unit receives the directional signals and determines the orientations of each of the powered vehicles, the heading determination unit may prompt an individual to check or otherwise confirm the determined directions, such as through graphics or text output to a monitor. Therefore, a vehicle operator may be able to quickly and easily address exceptions to the determined directions of the powered vehicle. In at least one other embodiment, the heading determination unit may receive information regarding track topology from an energy management system, for example, to check and verify the directional data received from the powered vehicles.

The directional data output by the directional sensors may be output to the heading determination unit during linking (that is, when the remote powered vehicles are communicatively and/or mechanically linked to the distributed power vehicle system), such as via distributed power link messages. For example, each remote powered vehicle may output the directional signals to the heading determination unit as they are linked to the distributed power vehicle system.

The vehicles may be mechanically coupled with each other (e.g., by couplers) or may not be mechanically coupled, but may be logically coupled. For example, the vehicles may not be connected with each other, but may communicate with each other via onboard communication devices to allow the vehicles and/or other devices described herein to communicate with each other. In one embodiment, the vehicles may communicate with each other to coordinate the propulsive and braking forces generated by the vehicles so that the vehicles travel together along the route as the vehicle system. Communicating the headings of separate vehicles can assist the lead or controlling vehicle to determine the proper commands to send to the remote or controlled vehicles to ensure that these vehicles move in the correct direction for the vehicles to move together and/or avoid collisions with each other. For example, without determining the heading or orientation of each remote vehicle, a lead vehicle may direct two remote vehicles to move in opposite directions, which can result in a collision between the vehicles. By determining the heading or orientation of each remote vehicle, the lead vehicle may ensure that the commands sent to the remote vehicles cause these vehicles to move in the same or common direction without risk or with a reduced risk of the vehicles colliding with each other.

In at least one embodiment, the directional data of the powered vehicles may be added to distributed power status messages for use by other applications. For example, an energy management system may use the directional data to determine when the powered vehicles are clear of a particular curve on a track that is subject to a speed restriction.

Embodiments of the disclosure may be used with respect to locomotives in a consist. For example, the intermediate powered vehicle may include a group of locomotives within a consist. Each locomotive within the consist may include an onboard directional sensor that outputs a directional signal. However, the locomotives within the consist may not be electrically coupled through wired connections. As such, the leading locomotive within each consist (and/or the lead powered vehicle) may receive the directional signals output from the directional sensors of each locomotive within a consist to determine the directional orientation of each locomotive within the consist. The trailing powered vehicles may communicate their directional orientations as part of status messages.

As described above, embodiments of the present disclosure provide systems and methods that allow remote powered vehicles to send directional orientation data to a lead powered vehicle, which may then automatically determine the directional orientations for each of the powered vehicles based on the received directional signals. As such, technical effects of embodiments of the present disclosure include reduction in setup errors, and allow for a distributed power vehicle system to be quickly and efficiently linked from the front. Moreover, embodiments of the present disclosure facilitate the adoption of wireless multiple unit vehicle systems as directional orientations of the powered vehicles are resolved. Further, the directional data for each of the powered vehicles may be used as part of an asset tracking status (ATS) message or a pinpoint message for use by train dispatching systems and yard planner systems, which may use the directional data to determine directional orientations for selecting applied power, or scheduling a vehicle turn operation when needed to get a vehicle turned in a correct direction.

As used herein, the term "control unit," "unit" (such as the heading determination unit), "central processing unit," "CPU," "computer," or the like may include any processor-based or microprocessor-based system including systems using microcontrollers, reduced instruction set computers (RISC), application specific integrated circuits (ASICs), logic circuits, and any other circuit or processor including hardware, software, or a combination thereof capable of executing the functions described herein. Such are exemplary only, and are thus not intended to limit in any way the definition and/or meaning of such terms. For example, the heading determination unit 512 (shown in FIG. 5) may be or include one or more processors that may control and/or direct operation of a vehicle system.

The heading determination unit may execute a set of instructions that are stored in one or more storage elements (such as one or more memories), to process data. For example, the heading determination unit may include or be coupled to one or more memories. The storage elements may store data or other information as desired or needed. The storage elements may be in the form of an information source or a physical memory element within a processing machine.

The set of instructions may include various commands that instruct the heading determination unit as a processing machine to perform specific operations such as the methods and processes of the various embodiments of the subject matter described herein. The set of instructions may be in the form of a software program. The software may be in various forms such as system software or application software. Further, the software may be in the form of a collection of separate programs, a program subset within a larger program or a portion of a program. The software may include modular programming in the form of object-oriented programming. The processing of input data by the processing machine may be in response to user commands, or in response to results of previous processing, or in response to a request made by another processing machine.

The diagrams of embodiments herein may illustrate one or more control or processing units, such as the heading determination unit. It is to be understood that the processing or control units may represent circuits, circuitry, or portions thereof that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the heading determination unit may represent processing circuitry such as one or more of a field programmable gate array (FPGA), application specific integrated circuit (ASIC), microprocessor(s), and/or the like. The circuits in various embodiments may execute one or more algorithms to perform functions described herein. The one or more algorithms may include aspects of embodiments disclosed herein, whether or not expressly identified in a flowchart or a method.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

Figure 6:
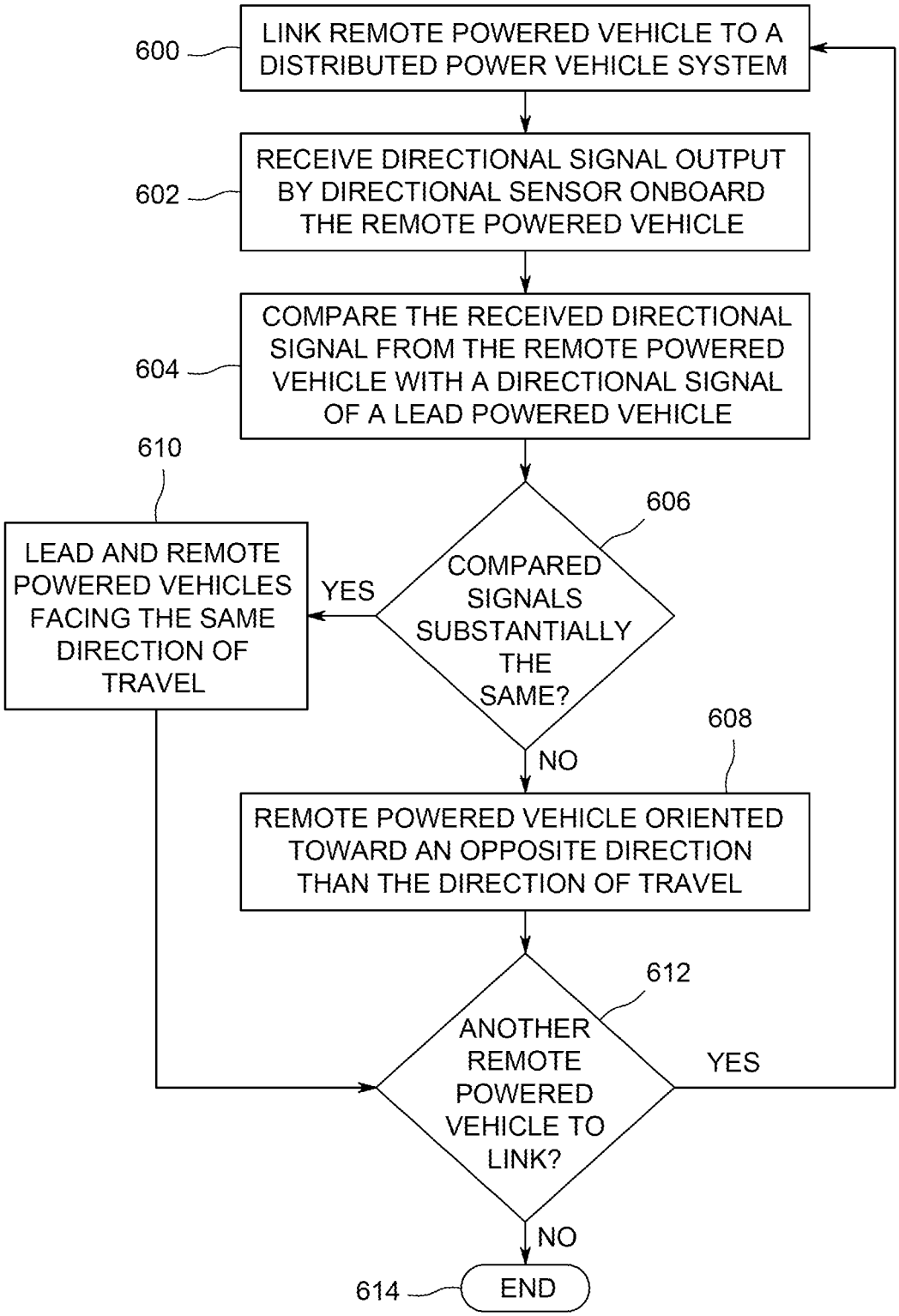
FIG. 6 illustrates a flow chart of a method of linking vehicles within a distributed power vehicle system, according to an embodiment of the present disclosure.

FIG. 6 illustrates a flowchart of a method of linking vehicles within a distributed power vehicle system, according to an embodiment of the present disclosure. Referring to FIGS. 5 and 6, the method begins at step 600, at which a remote powered vehicle (such as the remote powered vehicle) is linked to the distributed power vehicle system. In at least one embodiment, the remote powered vehicle is directly linked to the lead powered vehicle, thereby forming a consist or multi-vehicle system. In at least one other embodiment, the remote powered vehicle is linked to an unpowered vehicle coupled to the lead powered vehicle.

At step 602, the heading determination unit receives a directional signal that is output by a directional sensor (such as the directional sensor) onboard the remote powered vehicle. At step 604, the heading determination unit compares the received directional signal from the remote powered vehicle with a directional signal of the lead powered vehicle.

At step 606, the heading determination unit determines whether the compared directional signals are substantially the same. For example, the heading determination unit may determine that the compared signals are within a determined difference that accounts for curves, bends, turns, and/or the like within a particular route along which the distributed power vehicle system is located.

If the compared directional signals are not substantially the same, the heading determination unit determines at step 608 that the remote powered vehicle is oriented toward an opposite direction from a direction of a travel. If, however, the compared directional signals are substantially the same at step 606, the heading determination unit determines that the lead and remote powered vehicles face (for example, are oriented toward) the same direction of travel along the route.

Subsequent to steps 608 and 610, the method proceeds to step 612, in which the heading determination unit determines whether another remote powered vehicle is to be linked to the distributed power vehicle system. If not, the process may end at step 614 or return to one or more other operations. If, however, another remote powered vehicle is to be linked to the distributed power vehicle system, the method may return to step 600 or another operation.

Certain embodiments of the present disclosure provide a system that includes a lead powered vehicle including a first directional sensor that may output a first directional signal indicative of a first heading of the lead powered vehicle. A remote powered vehicle including a second directional sensor may output a second directional signal indicative of a second heading of the remote powered vehicle. The lead powered vehicle controls operation of the remote powered vehicle. A heading determination unit includes a communication interface and a controller. The communication interface may receive the first and second directional signals. The controller may determine an orientation for the second heading based on the first and second directional signals.

The heading determination unit may be onboard the lead powered vehicle. Alternatively, the heading determination unit may be remotely located from the vehicle system. In at least one embodiment, the heading determination unit compares the first directional signal with the second directional signal to determine the orientation of the second heading.

At least one of the first and second directional sensors may include a digital compass. Optionally, at least one of the first and second directional sensors may include a GNSS or GPS unit. The remote powered vehicle may be directly coupled to the lead powered vehicle, thereby forming a consist. Optionally, at least one other vehicle may be connected between the lead powered vehicle and the remote powered vehicle. The lead powered vehicle may be a lead locomotive on a track, and the remote powered vehicle is a remote locomotive on the track.

Certain embodiments of the present disclosure provide a method that includes disposing a first directional sensor onboard a lead powered vehicle, outputting (from the first directional sensor) a first directional signal indicative of a first heading of the lead powered vehicle, disposing a second directional sensor onboard a remote powered vehicle that is controlled by the lead powered vehicle, outputting (from the second directional sensor) a second directional signal indicative of a second heading of the remote powered vehicle, receiving the first and second directional signals at a heading determination unit, and determining (by the heading determination unit) an orientation for the second heading based on the first and second directional signals.

The method may include disposing the heading determination unit onboard the lead powered vehicle. Alternatively, the method may include remotely locating the heading determination unit from the vehicle system. The determining may include comparing the first directional signal with the second directional signal to determine the orientation of the second heading.

The method may include directly coupling the remote powered vehicle to the lead powered vehicle. Optionally, the method may include connecting at least one other vehicle between the lead powered vehicle and the remote powered vehicle.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that incorporate the recited features. Moreover, unless explicitly stated to the contrary, embodiments "comprising," "including," or "having" an element or a plurality of elements having a particular property may include additional such elements not having that property.

What is claimed is:

1. A system for a vehicle group having a first and second vehicle, comprising:

a first directional sensor configured to output a first directional signal indicative of a first orientation of the first vehicle;

a second directional sensor configured to output a second directional signal indicative of a second orientation of the second vehicle; and a heading determination unit having a communication interface and a controller, the communication interface configured to receive the first and second directional signals, the controller is configured to establish a communication link between the first vehicle and the second vehicle for coordinating movements of the first vehicle and the second vehicle based on the first orientation and the second orientation, the controller configured to prevent movement of the first vehicle responsive to the first orientation and the second orientation indicating that the first vehicle and the second vehicle are on a common or same route.

2. The system of claim 1, wherein the heading determination unit is onboard the first vehicle.

3. The system of claim 1, wherein the heading determination unit is remotely located from the first and second vehicles.

4. The system of claim 1, wherein the vehicle group is a train, and the heading determination unit is included within a head of train (HOT) device or an end of train (EOT) device.

5. The system of claim 1, wherein the heading determination unit is configured to compare the first directional signal with the second directional signal to determine the second orientation of the second vehicle.

6. The system of claim 1, wherein the controller is configured to create plural performance models based at least in part on anticipated sensor inputs during operation of the vehicle group, to determine an operational plan from a comparison of the plural performance models, and to direct the vehicle group to operate according to the operational plan.

7. The system of claim 1, wherein the first and second vehicles are mechanically separate but logically coupled with each other in the vehicle group such that the first and second vehicles travel together as the vehicle group.

8. The system of claim 1, at least a third vehicle is disposed at least partially between the first vehicle and the second vehicle.

9. A method comprising:

obtaining a first directional signal from a first directional sensor onboard a first vehicle, the first directional signal indicative of a first heading of the first vehicle;

obtaining a second directional signal from a second directional sensor onboard a second vehicle, the second directional signal indicative of a second heading of the second vehicle;

establishing a communication link between the first vehicle and the second vehicle based on the first heading of the first vehicle and the second heading of the second vehicle; and preventing movement of the first vehicle responsive to the first heading and the second heading indicating that the first vehicle and the second vehicle are on a common or same route.

10. The method of claim 9, wherein at least one of the first or second directional signals is received from a digital compass.

11. The method of claim 9, wherein at least one of the first or second directional signals is received from a global navigation satellite system unit.

12. The method of claim 9, wherein at least one of the first directional signal or the second directional signal is received from a head of vehicle unit or an end of vehicle unit.

13. A heading determination unit comprising:

a communication interface; and a controller operably coupled to the communication interface and having at least one processor, the communication interface configured to receive a first directional signal from a first directional sensor of a first vehicle, the first directional signal indicative of a first heading of the first vehicle, the communication interface configured to receive a second directional signal from a second directional sensor of a second vehicle, the second directional signal indicative of a second heading of the second vehicle, and the controller is configured to establish a wireless communication link between the first vehicle and the second vehicle based on the first directional signal and the second directional signal, the controller configured to prevent movement of the first vehicle based on the first directional signal and the second directional signal indicating that the first vehicle and the second vehicle are on a same or common route.

14. The heading determination unit of claim 13, wherein the first vehicle and the second vehicle are mechanically coupled with each other.

15. The heading determination unit of claim 13, wherein the first vehicle and the second vehicle are not directly or indirectly mechanically coupled with each other.

16. The heading determination unit of claim 13, wherein the controller is configured to permit movement of the first vehicle based on the first directional signal and the second directional signal indicating that the first vehicle and the second vehicle are on different routes.

17. The heading determination unit of claim 13, wherein the first vehicle and the second vehicle are automobiles.

* * * * *